US010948204B2

(12) United States Patent
Luo

(10) Patent No.: US 10,948,204 B2
(45) Date of Patent: Mar. 16, 2021

(54) HUMIDIFIER CAPABLE OF RELEASING NATURAL NEGATIVE IONS

(71) Applicant: DONGGUAN ZUOQI ELECTRONIC CO., LTD., Guangdong (CN)

(72) Inventor: Yingchun Luo, Dongguan (CN)

(73) Assignee: DONGGUAN ZUOQI ELECTRONIC CO., LTD., Guangdong (CN)

( * ) Notice: Subject to any disclaimer, the term of this patent is extended or adjusted under 35 U.S.C. 154(b) by 235 days.

(21) Appl. No.: 16/362,724

(22) Filed: Mar. 25, 2019

(65) Prior Publication Data

US 2019/0301756 A1 Oct. 3, 2019

(30) Foreign Application Priority Data

Mar. 27, 2018 (CN) ..... 201810257948.3

(51) Int. Cl.

| | |
|---|---|
| ***F24F 6/02*** | (2006.01) |
| ***F24F 6/12*** | (2006.01) |
| ***B01F 3/04*** | (2006.01) |
| *F24F 6/00* | (2006.01) |

(52) U.S. Cl.

CPC ..... *F24F 6/025* (2013.01); *B01F 3/04* (2013.01); *F24F 6/12* (2013.01); *F24F 2006/008* (2013.01)

(58) Field of Classification Search

CPC ..... F24F 6/12; F24F 6/025; B01F 3/04

See application file for complete search history.

(56) References Cited

FOREIGN PATENT DOCUMENTS

CN 110212410 A * 9/2019

* cited by examiner

*Primary Examiner* — Robert A Hopkins

(74) *Attorney, Agent, or Firm* — Leong C. Lei

(57) ABSTRACT

A humidifier capable of releasing natural negative ions includes a humidifier body and a halite module. After an atomized gas generated from a second atomized gas outlet of the humidifier body flows into an mixing chamber, the atomized gas is controlled in the mixing chamber, part of the atomized gas flows into an accommodation chamber through perforations to be in contact with a halite, negative ions released by the halite is introduced into the mixing chamber through the perforations, the negative ions merge with the atomized gas in the mixing chamber to form the atomized gas with negative ions, and the atomized gas with the negative ions is discharged via a first atomized gas outlet, thereby solving the problem that the halite is quickly dissolved and deformed by moisture.

10 Claims, 4 Drawing Sheets

HUMIDIFIER CAPABLE OF RELEASING NATURAL NEGATIVE IONS

BACKGROUND OF THE INVENTION

1. Field of the Invention

The present invention relates to a humidifier, and more particularly to a humidifier capable of releasing natural negative ions.

2. Description of the Prior Art

In these days, a humidifier is widely used. Considering the needs of different users and different occasions, it is possible to add some plant essential oils to the water molecules, so that the atomized water vapor is emitted into the air to make the air full of fragrance.

Some humidifiers are combined with a halite to generate negative ions for purifying the air. For example, Chinese patent application publication No. CN106871309A discloses an aroma humidifier. The aroma humidifier atomizes water in a water tank through an atomizing assembly to generate fog and blows it out to the environment around the crystal halite to increase the ambient humidity around the crystal halite. In the case of high water content, the crystal halite releases negative ions after heating, so that the air in the surrounding environment can be purified.

In the technical solution disclosed in the above Chinese patent application publication No. CN106871309A, since the atomized gas is directly sprayed to the crystal halite, in actual use, the halite tends to dissolve too quickly. On the one hand, the halite will be deformed by moisture, which seriously affects the original shape of the halite, resulting in no decoration of its own, without beauty; on the other hand, due to the rapid release of halite, the use of halite is short. Furthermore, it is also an extremely important aspect that it is difficult to control the concentration of negative ions, and that it is difficult to keep the release of negative ions stable. Therefore, it also affects the control of air purification.

Accordingly, the inventor of the present invention has devoted himself based on his many years of practical experiences to solve these problems.

SUMMARY OF THE INVENTION

In view of the shortcomings of the prior art, the primary object of the present invention is to provide a humidifier capable of releasing natural negative ions. The present invention solves the problem that the halite is quickly dissolved and deformed by moisture, and can effectively prolong the use of the halite and ensure that the halite maintains a good shape. In particular, the atomized gas with negative ions is more uniform and stable in quality. The effect of purifying the air is reliable.

In order to achieve the above object, the present invention adopts the following technical solutions:

A humidifier capable of releasing natural negative ions comprises a humidifier body and a halite module. The halite module includes a halite storage housing and a halite The halite storage housing has an accommodation chamber. The halite is installed in the accommodation chamber. The halite storage housing has an atomized gas inlet and a first atomized gas outlet. A mixing chamber is disposed between the atomized gas inlet and the first atomized gas outlet. The humidifier body has an atomizing assembly and a second atomized gas outlet. The halite module is detachably mounted on the humidifier body. The atomized gas inlet is in communication with the second atomized gas outlet. A wall of the mixing chamber is provided with a plurality of perforations communicating with the accommodation chamber. The atomized gas inlet is in communication with the accommodation chamber through the mixing chamber and the perforations. The first atomized gas outlet is in communication with the mixing chamber. After an atomized gas generated from the second atomized gas outlet of the humidifier body flows into the mixing chamber, the atomized gas is controlled in the mixing chamber, part of the atomized gas flows into the accommodation chamber through the perforations to be in contact with the halite, negative ions released by the halite is introduced into the mixing chamber through the perforations, the negative ions merge with the atomized gas in the mixing chamber to form the atomized gas with the negative ions, and the atomized gas with the negative ions is discharged via the first atomized gas outlet.

The present invention has obvious advantages and beneficial effects compared with the prior art. Specifically, it can be known from the above technical solutions. Through the arrangement of the mixing chamber, after an atomized gas generated from the second atomized gas outlet of the humidifier body flows into the mixing chamber, the atomized gas is controlled in the mixing chamber, part of the atomized gas flows into the accommodation chamber through the perforations to be in contact with the halite, negative ions released by the halite is introduced into the mixing chamber through the perforations, the negative ions merge with the atomized gas in the mixing chamber to form the atomized gas with the negative ions, and the atomized gas with the negative ions is discharged via the first atomized gas outlet. The present invention solves the problem that the halite is quickly dissolved and deformed by moisture, and can effectively prolong the use of the halite and ensure that the halite maintains a good shape. In particular, the atomized gas with negative ions is more uniform and stable in quality. The effect of purifying the air is reliable.

DETAILED DESCRIPTION OF THE PREFERRED EMBODIMENTS

Figure 1:
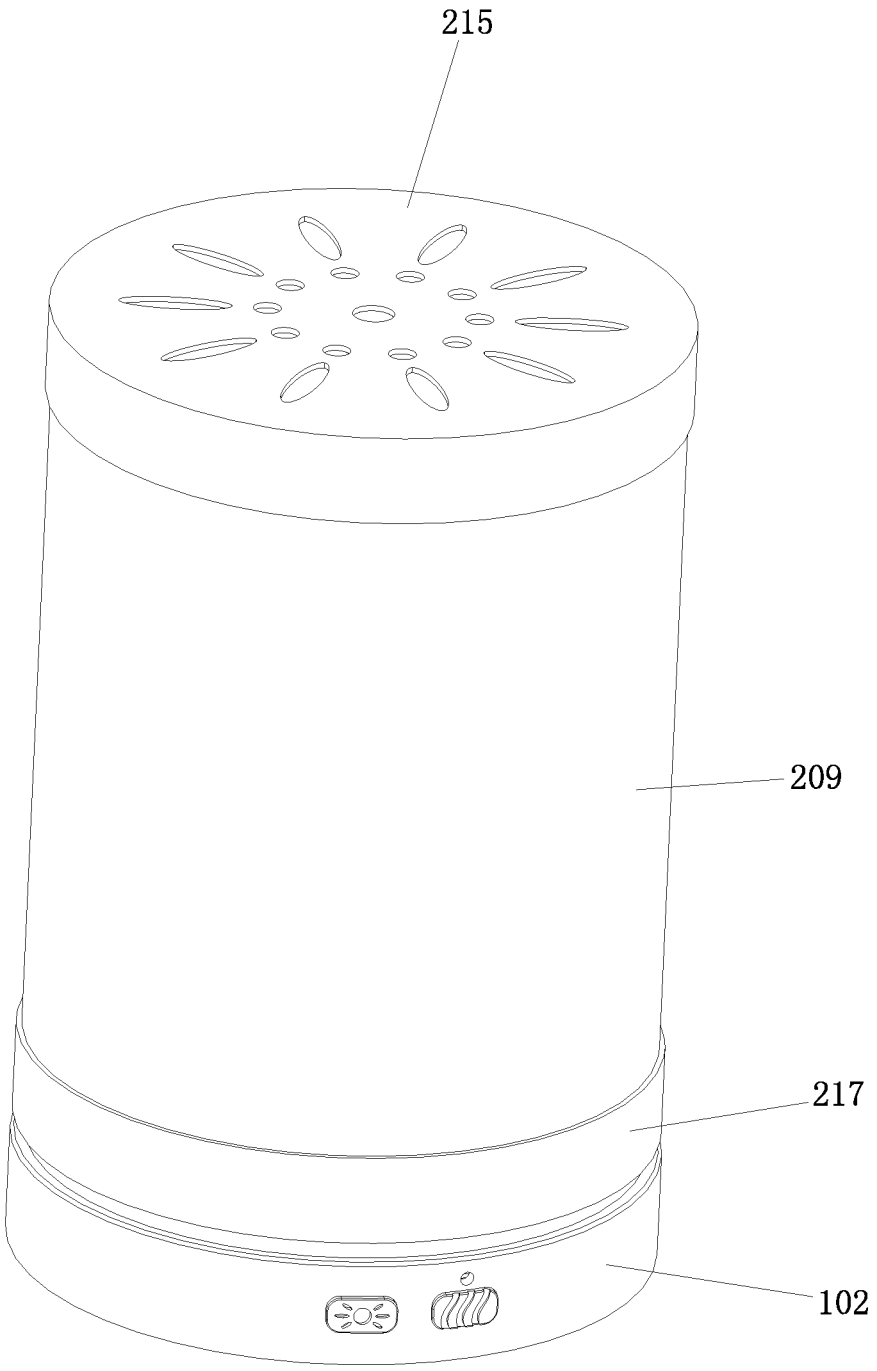
FIG. 1 is a perspective view in accordance with a preferred embodiment of the present invention.
Figure 2:
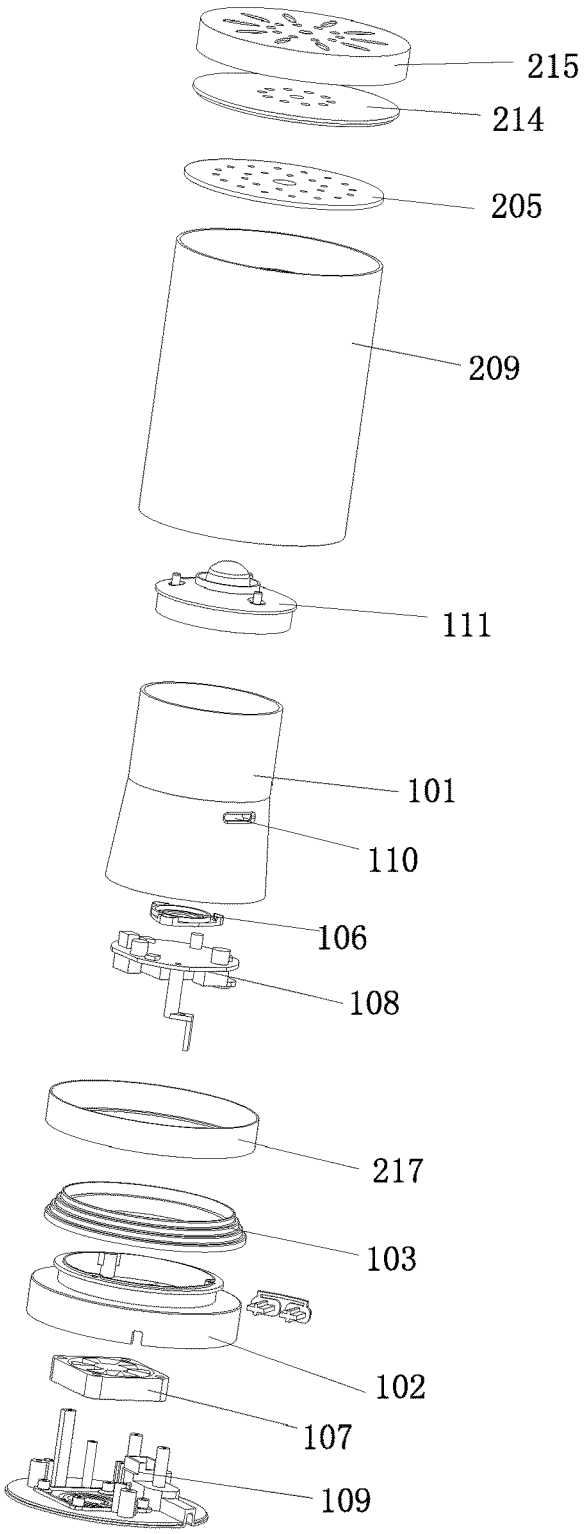
FIG. 2 is an exploded view in accordance with the preferred embodiment of the present invention.

Embodiments of the present invention will now be described, by way of example only, with reference to the accompanying drawings.

Referring to FIG. 1 through FIG. 4, there is shown a specific structure of a preferred embodiment of the present invention. In this description, an aromatherapy humidifier capable of releasing natural negative ions with an LED light is taken as an example, but is not limited to such a product.

A humidifier capable of releasing natural negative ions comprises a humidifier body 100 and a halite module 200. The halite module 200 includes a halite storage housing 303 and a halite 201. The halite storage housing 303 has an accommodation chamber 304. The halite 201 is installed in the accommodation chamber 304. The halite storage housing 303 has an atomized gas inlet 202 and a first atomized gas outlet 203. A mixing chamber 204 is disposed between the atomized gas inlet 202 and the first atomized gas outlet 203.

The humidifier body 100 has an atomizing assembly 106 and a second atomized gas outlet 112.

The halite module 200 is detachably mounted on the humidifier body 100. The atomized gas inlet 202 is in communication with the second atomized gas outlet 112. The wall of the mixing chamber 204 is provided with a plurality of perforations 207 communicating with the accommodation chamber 304. The atomized gas inlet 202 is in communication with the accommodation chamber 304 through the mixing chamber 204 and the perforations 207 in sequence. The first atomized gas outlet 203 is in communication with the mixing chamber 204.

After an atomized gas generated from the second atomized gas outlet 112 of the humidifier body 100 flows into the mixing chamber 204, the atomized gas is controlled in the mixing chamber 204. Part of the atomized gas flows into the accommodation chamber 304 through the perforations 207 to be in contact with the halite 201. Negative ions released by the halite 201 are introduced into the mixing chamber 204 through the perforations 207. The negative ions merge with the atomized gas in the mixing chamber 204 to form the atomized gas with the negative ions. The atomized gas with the negative ions is discharged through the first atomized gas outlet 203. Preferably, the atomized gas inlet 202 is not in direct communication with the accommodation chamber 304. The atomized gas generated from the second atomized gas outlet 112 of the humidifier body 100 is not directly sprayed on the halite 201.

In this embodiment, the halite module 200 is replaceable, that is, after the halite is used up, another halite module 200 can be installed. An example of an assembled structure of the halite module 200 on the humidifier body 100 is provided.

The humidifier body 100 has a connecting portion 301. The second atomized gas outlet 112 is disposed at the top of the connecting portion 301. The halite storage housing 303 has a cylinder portion 302. The cylinder portion 302 includes an inner cylinder wall 208 and an outer cylinder wall 209. The bottom ends of the inner cylinder wall 208 and the outer cylinder wall 209 are connected to each other to form the annular accommodation chamber 304. The atomized gas inlet 202 is formed at an upper end of the inner cylinder wall 208. The halite storage housing 303 is sleeved on the connecting portion 301 of the humidifier body 100 through the cylinder portion 302. A partition portion 205 is disposed above the inner cylinder wall 208. The partition portion 205 is configured to separate the halite 201 from the mixing chamber 204. The partition portion 205 is formed with the perforations 207. The partition portion 205 is provided with a through hole 206 communicating with the atomized gas inlet 202. The perforations 207 of the partition portion 205 are preferably designed to be dense and small. In this way, the halite 201 can be wetted, but the halite is not dissolved too quickly. The perforations 207 are disposed around the through hole 206. Thus, the atomized gas flows upwardly via the through hole 206, and then fills the entire mixing chamber 204 in the radial direction of the through hole 206.

Figure 3:
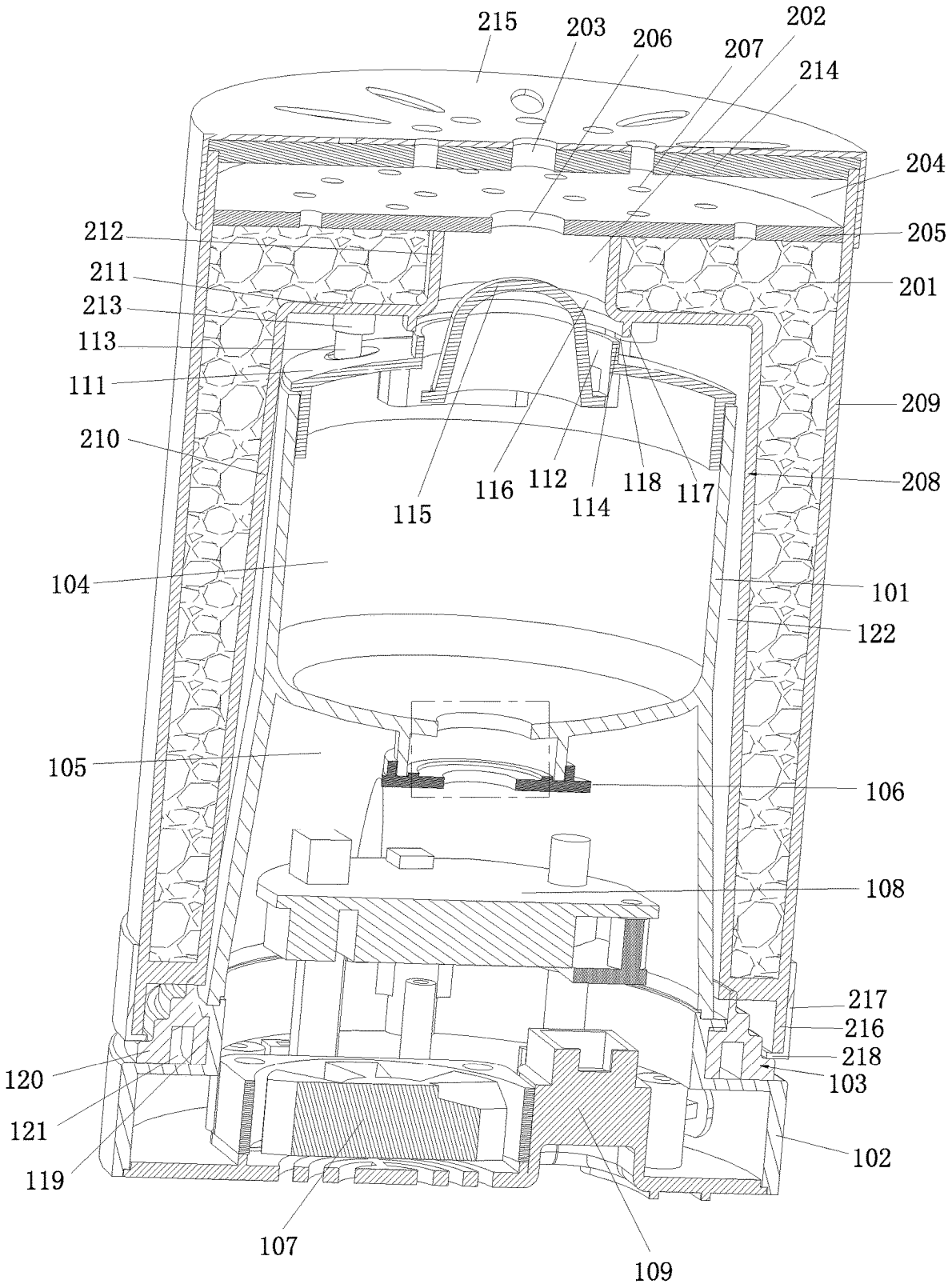
FIG. 3 is a cross-sectional view in accordance with the preferred embodiment of the present invention.
Figure 4:
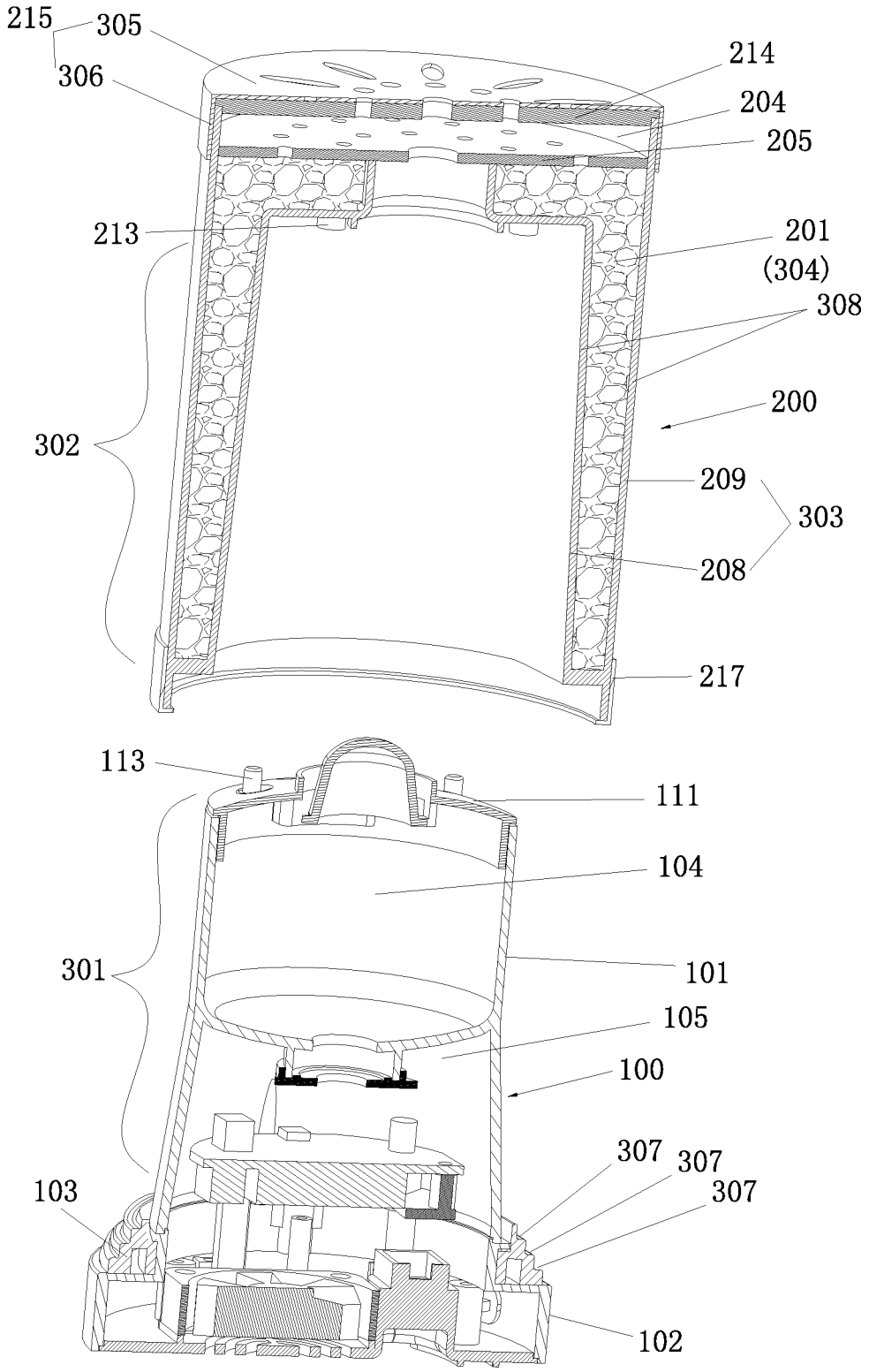
FIG. 4 is an exploded cross-sectional view in accordance with the preferred embodiment of the present invention.

As shown in FIG. 3, the inner cylinder wall 208 includes a tapered segment 210, an annular segment 211, and a guide opening segment 212. The annular segment 211 extends inwardly from the upper end of the tapered segment 210. The guide opening segment 212 extends upwardly from the inner end of the annular segment 211. The tapered segment 210 is tapered from bottom to top, and the connecting portion 301 is also tapered from bottom to top. The annular accommodation chamber 304 is enlarged from bottom to top, which is beneficial for the atomized gas to flow into the accommodation chamber 304 through the holes 207. The design of the annular segment 211 can flexibly control the size of the opening of the guide opening segment 212, that is, the size of the atomized gas inlet 202. Besides, the annular segment 211 also provides a support surface for the halite 201, increasing the amount of the halite 201 placed and the area at which the top halite 201 is placed.

Atop lid 214 is disposed above the partition portion 205. The top lid 214 and the partition portion 205 are vertically spaced apart. The first atomized gas outlet 203 is disposed on the top lid 214. Preferably, the first atomized gas outlet 203 of the top lid 214 is not aligned with the perforations 207 in a vertical direction. The atomized gas in the mixing chamber 204 does not be directly discharged toward the first atomized gas outlet 203, but is filled in the mixing chamber 204. Part of the atomized gas flows downwardly to wet the halite 201 via the perforations 207. The halite 201 releases the natural negative ions upwardly after being wetted. The natural negative ions flow upwardly to enter the mixing chamber 204 via the perforations 207 to fully integrate with the atomized gas in the mixing chamber 204. The gas diffused from the first atomized gas outlet 203 of the top lid 214 is an atomized gas with natural negative ions. (According to the actual situation, it may be designed as aromatherapy atomized gas containing natural negative ions.) The top lid 214 is connected to an upper end of the outer cylinder wall 209. The mixing chamber 204 is enclosed by the top lid 214, the outer cylinder wall 209 and the partition portion 205. The upper end of the outer cylinder wall 209 extends beyond the partition portion 205. A fixing decorative cover 215 is fitted on top of the top lid 214. The fixing decorative cover 215 has a top plate portion 305 and an annular circumferential plate portion 306 connected to a lower peripheral edge of the top plate portion 305. The top plate portion 305 is located above the top lid 214. The annular circumferential plate portion 306 is fitted on the outer periphery of the outer cylinder wall 209. In this embodiment, the top plate portion 305 is formed with a plurality of outer holes in communication with the outside air. The top plate portion 305 may have a hollow design in other shapes. For the decoration effect and strengthening the structural strength, anti-drop and anti-deformation performance of the halite module 200, the fixing decorative cover 215 is made of a hard and strong material, such as a metal material. The lower end of the halite storage housing is sleeved with a lower fixing cylinder 217. The lower end of the outer cylinder wall 209 extends downwardly to form an extension side 216. The lower fixing cylinder 217 is sleeved on the outer circumference of the outer cylinder wall 209. The bottom end of the lower fixing cylinder 217 is connected with an annular baffle 218. The annular baffle 218 is limited to the bottom end of the extension side 216 to form a hook limit In this way, the lower side is fixed, that is, the lower end of the halite storage housing 303 is covered and fixed Similarly, the upper end of the halite storage housing 303 is covered and fixed by the fixing decorative cover 215. If the halite module 200 is designed to be added with a halite, the partition portion 205, the top lid 214, and the halite storage housing 303 are designed to be a detachable structure for adding the halite An air passage 122 is defined between the connecting portion 301 of the humidifier body 100 and the inner cylinder wall 208. An upper end of the air passage 122 is in communication with the atomized gas inlet 202. The humidifier body 100 has a fan assembly 107. The humidifier body 100 has a heating unit 108. The fan assembly 107 is configured to create a current of air toward the heating unit 108 to form hot air that is blown toward the atomized gas inlet 202. The connecting portion 301 of the humidifier body 100 includes a connecting housing 101. The connecting housing 101 has an upper accommodating chamber 104 and a lower accommodating chamber 105 therein. The upper accommodating chamber 104 is a liquid storage chamber. Both the fan assembly 107 and the heating unit 108 are located in the lower accommodating chamber 105. The fan assembly 107 creates a current of air to blow upwardly. The heating unit 108 is disposed above the fan assembly 107 and corresponds to the bottom of the upper accommodating chamber 104. The side wall of the lower accommodating chamber 105 is formed with an air outlet 110 communicating with the air passage 122. The design of the upper accommodating chamber 104 and the lower accommodating chamber 105 is reasonable in design and ingenious. The heating unit 108 faces the bottom of the upper accommodating chamber 104 and provides a certain heating effect for the liquid in the upper accommodating chamber 104, which is favorable for the generation of the atomized gas. The fan assembly 107 faces the heating unit 108 to blow air upwardly. The hot air formed in the lower accommodating chamber 105 is confined by the top wall and the peripheral side wall of the lower accommodating chamber 105, and is cycled and slowed down. Then, the hot air flows to the air passage 122 from the air outlet 110 of the circumferential wall, which is beneficial for control of the hot air.

The upper accommodating chamber 104 serves as a liquid storage chamber. It is convenient to add liquid from the top toward the upper accommodating chamber 104. (The liquid may be water, or a mixture of water and plant essential oil, or other suitable liquid to provide a fragrance-free humidification or aroma humidification effect.) The upper end of the upper accommodating chamber 104 has an opening that is opened and closed by a liquid storage plug 111. The liquid storage plug 111 is provided with a positioning post 113 protruding upwardly. The annular segment 211 is formed with a positioning hole corresponding to the positioning post 113. The positioning hole is formed by a concave hole inside a protrusion 213 at the bottom of the annular segment 211. In this way, after the halite module 200 is aligned, it is sleeved on the connecting portion 301 of the humidifier body 100 from top to bottom. The matching of the positioning hole and the positioning post 113 improves the assembly and positioning between the halite module 200 and the humidifier body 100.

The liquid storage plug 111 is provided with the second atomized gas outlet 112. The second atomized gas outlet 112 is surrounded by a first annular guiding wall 114 and a convex spherical guiding member 115. A first annular gap 112 is formed between the first annular guiding wall 114 and the convex spherical guiding member 115, equivalent to the annular second atomized gas outlet 112. Of course, it is possible to design discontinuous grooves arranged in a ring shape. The upper end of the convex spherical guiding member 115 extends into the guide opening segment 212. A second annular gap 116 is defined between the convex spherical guiding member 115 and the guide opening segment 212. The atomized gas generated from the second atomized gas outlet 112 passes through the first annular gap 112 and the second annular gap 116 to the atomized gas inlet 202, and then enters the mixing chamber 204 via the through hole 206 of the partition portion 205. A second annular guiding wall 117 extends downwardly from the bottom of the annular segment 211. A third annular gap 118 is defined between the second annular guiding wall 117 and the first annular guiding wall 114 for the upper end of the air passage 122 to communicate with the atomized gas inlet 202 through the third annular gap 118 and the second annular gap 117. The outside of the convex spherical guiding member 115 is tapered upwardly, which is favorable for the atomized gas to be discharged upwardly from the upper accommodating chamber 104. Furthermore, it is also ensured that the hot air in the air passage 122 is mixed with the atomized gas in the second annular gap 116 and the atomized gas inlet 202, and the hot air does not blow downwardly into the upper accommodating chamber 104 to cause backflow.

A lower end of the connecting portion 301 of the humidifier body 100 is provided with at least two annular engaging portions 307. The annular engaging portions 307 each have an outer ring that is gradually enlarged from top to bottom. All the annular engaging portions are arranged in the form of steps. On the one hand, this design ensures that the halite module 200 can be well matched with the humidifier body 100 to overcome the dimensional deviation of the lower end caused by the manufacturing tolerances of the halite module 200, etc. On the other hand, this stepped design allows the same humidifier body 100 to match halite modules 200 of different sizes. In short, the assembly versatility of the humidifier body 100 is improved. In this embodiment, the annular engaging portions 307 are formed on an engaging member 103. The engaging member 103 has an engaging inner ring 119 and an engaging outer ring 120. All the annular engaging portions 307 are formed on the engaging outer ring 120. The upper ends of the engaging inner ring 119 and the engaging outer ring 120 are connected together. A deformation gap 121 is defined between the engaging inner ring 119 and the engaging outer ring 120. The lower end of the connecting housing 101 is connected with a base 102. The engaging member 103 is sleeved on the base 102. The engaging member 103 is configured to connect the connecting housing 101 with the base 102. The engaging member 103 covers the joint portion of the connecting housing 101 and the base 102. The design of the deformation gap 121 further improves the assembly, feasibility and simplicity of the halite module 200 fitted on the engaging member 103. An annular mounting surface is provided on the base 102 for supporting the engaging member 103. The base 102 has an upper limiting surface corresponding to the upper side of the annular mounting surface. The base 102 is formed with an annular engaging groove between the annular mounting surface and the upper limiting surface. After the engaging member 103 is fitted onto the base 102, the engaging inner ring 119 is engaged in the annular engaging groove, and the engaging outer ring 120 is located outside the annular engaging groove.

Furthermore, the halite storage housing 303 has a light-permeable wall 308. The humidifier body 100 is provided with a light-emitting unit (not shown in the drawings). The light generated from the light-emitting unit passes through the halite to illuminate outward. In this embodiment, the connecting housing 101 is made of a light-permeable material, and the halite storage housing 303 is a transparent structure, so that the appearance of the halite can be seen from the outside, providing a better decorative effect. The light-emitting unit generally refers to an LED light. The light of the LED light is emitted through the halite The light emitted by the LED light is soft, which not only increases the atmosphere but also can be used as a night light for night illumination. The LED light is preferably an LED light capable of adjusting brightness, so that the light can be adjusted according to actual conditions to present different light effects.

In this embodiment, a power supply unit 109 is disposed in the humidifier body 100. The power supply unit 109 is electrically connected to the atomizing assembly 106, the fan assembly 107, the heating unit 108, and the light-emitting unit, respectively. The power supply unit may be a built-in rechargeable power supply, or an external power supply through a power supply line. The power supply unit may have both the power supply modes, and the like.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A humidifier capable of releasing natural negative ions, comprising a humidifier body and a halite module;

the halite module including a halite storage housing and a halite, the halite storage housing having an accommodation chamber, the halite being installed in the accommodation chamber, the halite storage housing having an atomized gas inlet and a first atomized gas outlet; a mixing chamber being disposed between the atomized gas inlet and the first atomized gas outlet;

the humidifier body having an atomizing assembly and a second atomized gas outlet;

the halite module being detachably mounted on the humidifier body, the atomized gas inlet being in communication with the second atomized gas outlet; a wall of the mixing chamber being provided with a plurality of perforations communicating with the accommodation chamber, the atomized gas inlet being in communication with the accommodation chamber through the mixing chamber and the perforations, the first atomized gas outlet being in communication with the mixing chamber;

wherein after an atomized gas generated from the second atomized gas outlet of the humidifier body flows into the mixing chamber, the atomized gas is controlled in the mixing chamber, part of the atomized gas flows into the accommodation chamber through the perforations to be in contact with the halite, negative ions released by the halite being introduced into the mixing chamber through the perforations, the negative ions merging with the atomized gas in the mixing chamber to form the atomized gas with the negative ions, and the atomized gas with the negative ions is discharged via the first atomized gas outlet.

2. The humidifier as claimed in claim 1, wherein the atomized gas inlet is not in direct communication with the accommodation chamber, and the atomized gas generated from the second atomized gas outlet of the humidifier body is not directly sprayed on the halite.

3. The humidifier as claimed in claim 1, wherein the humidifier body has a connecting portion, the second atomized gas outlet is disposed at a top of the connecting portion;

the halite storage housing has a cylinder portion, the cylinder portion includes an inner cylinder wall and an outer cylinder wall, bottom ends of the inner cylinder wall and the outer cylinder wall are connected to each other to form the accommodation chamber; the atomized gas inlet is formed at an upper end of the inner cylinder wall;

the halite storage housing is sleeved on the connecting portion of the humidifier body through the cylinder portion;

a partition portion is disposed above the inner cylinder wall, the partition portion is configured to separate the halite from the mixing chamber, the partition portion is formed with the perforations, the partition portion is provided with a through hole communicating with the atomized gas inlet.

4. The humidifier as claimed in claim 3, wherein a top lid is disposed above the partition portion, the top lid and the partition portion are vertically spaced apart, the first atomized gas outlet is disposed on the top lid, the top lid is connected to an upper end of the outer cylinder wall, and the mixing chamber is enclosed by the top lid, the outer cylinder wall and the partition portion.

5. The humidifier as claimed in claim 4, wherein the upper end of the outer cylinder wall extends beyond the partition portion, a fixing decorative cover is fitted on top of the top lid, the fixing decorative cover has a top plate portion and an annular circumferential plate portion connected to a lower peripheral edge of the top plate portion, the top plate portion is located above the top lid, and the annular circumferential plate portion is fitted on an outer periphery of the outer cylinder wall.

6. The humidifier as claimed in claim 3, wherein an air passage is defined between the connecting portion of the humidifier body and the inner cylinder wall, an upper end of the air passage is in communication with the atomized gas inlet; and the humidifier body has a fan assembly.

7. The humidifier as claimed in claim 6, wherein the humidifier body has a heating unit, the fan assembly is configured to create a current of air toward the heating unit to form hot air that is blown toward the atomized gas inlet.

8. The humidifier as claimed in claim 3, wherein the halite storage housing has a light-permeable wall, the humidifier body is provided with a light-emitting unit, and light generated from the light-emitting unit passes through the halite to illuminate outward.

9. The humidifier as claimed in claim 3, wherein a lower end of the connecting portion of the humidifier body is provided with at least two annular engaging portions, the annular engaging portions each have an outer ring that is gradually enlarged from top to bottom, and the annular engaging portions are arranged in the form of steps.

10. The humidifier as claimed in claim 7, wherein the connecting portion of the humidifier body includes a connecting housing, the connecting housing has an upper accommodating chamber and a lower accommodating chamber therein, the upper accommodating chamber is a liquid storage chamber, the fan assembly and the heating unit are located in the lower accommodating chamber, the fan assembly creates a current of air to be blown upwardly, the heating unit is disposed above the fan assembly and corresponds to a bottom of the upper accommodating chamber, and a side wall of the lower accommodating chamber is formed with an air outlet communicating with the air passage.

* * * * *